US005970885A

United States Patent [19]

Polando

[11] Patent Number: 5,970,885

[45] Date of Patent: Oct. 26, 1999

[54] SHIPPING SKID

[76] Inventor: Benjamin F. Polando, 4601 Clipper Dr., Discovery Bay, Calif. 94514

[21] Appl. No.: 09/216,892

[22] Filed: Dec. 18, 1998

[51] Int. Cl.[6] ..... B65D 19/44

[52] U.S. Cl. ..... 108/55.3

[58] Field of Search ..... 108/55.1, 55.3, 108/55.5, 57.1, 57.12

[56] References Cited

U.S. PATENT DOCUMENTS

| | | | |
|---|---|---|---|
| 3,478,995 | 11/1969 | Lautzenhiser et al. | 108/55.5 X |
| 3,622,114 | 11/1971 | McIntire, Jr. | 108/55.5 X |
| 3,962,660 | 6/1976 | Duckett | 108/55.3 X |
| 5,109,985 | 5/1992 | Rose | 108/55.1 X |
| 5,180,134 | 1/1993 | Mallak | 108/55.1 X |
| 5,193,598 | 3/1993 | Estrem | 108/55.3 X |
| 5,195,439 | 3/1993 | Harder | 108/57.12 |
| 5,529,185 | 6/1996 | Alspach et al. | 108/55.5 X |
| 5,676,063 | 10/1997 | Wallace | 108/55.3 X |
| 5,722,328 | 3/1998 | Darby | 108/55.1 |
| 5,829,363 | 11/1998 | Reilly | 108/55.1 |
| 5,842,424 | 12/1998 | Prévot et al. | 108/55.3 X |

FOREIGN PATENT DOCUMENTS

| | | | |
|---|---|---|---|
| 297126 | 1/1992 | Germany | 108/55.1 |

*Primary Examiner*—Jose V. Chen

*Attorney, Agent, or Firm*—Limbach & Limbach L.L.P.

[57] ABSTRACT

A shipping skid, which is used for shipping an article that is mounted on a plurality of feet, includes a base member, a plurality of skid members attached to a bottom surface of the base member, a platform attached to a top surface of the base member via elastic members, and a plurality of mounting plates attached to a top surface of the platform. Each of the mounting plates includes a plurality of clamp channels formed into the top surface thereof, a plurality of receptacles formed into a top surface thereof that are each overlapped by at least one of the clamp channels, and at least one clamp member having engagement prongs and which is removably and selectively attachable into each of the clamp channels. When an article foot is inserted into one of the receptacles and the clamp member is attached into the corresponding clamp channel that overlaps that receptacle, the engagement prongs engage with the foot and secure the foot to the mounting plate. For each mounting plate, at least one of the clamp channels does not overlap the receptacles, and thus when an article foot is inserted into, and the clamp member is attached into, the non-overlapping clamp channel, the engagement prongs engage with the foot and secure the foot to the mounting plate. The plurality of channels and receptacles in a single skid support and secure various sized articles even though such articles can have different foot sizes, spacings and patterns.

15 Claims, 5 Drawing Sheets

SHIPPING SKID

FIELD OF THE INVENTION

The present invention relates to shipping skids, and more particularly to a versatile shipping skid for shipping articles having various foot patterns.

BACKGROUND OF THE INVENTION

Shipping skids are well known in the art, and include a base platform onto which articles to be shipped are placed. Elongated skid members support the platform from underneath so that the prongs of a fork lift can be inserted between the skid members and engage the underside of the platform for picking up and moving the skid. Four side walls and a lid can be attached to the shipping skid to form a shipping container.

Many types of articles to be shipped on skids are mounted on feet. However, when articles are shipped using commercial carriers, they need to be placed on skids so that they can be picked up and moved by fork lifts. To protect the article from moving around on the skid during shipment, some skids have receptacles for the feet. However, since the foot patterns of many similarly sized articles are different (i.e. distance between feet varies for different types of articles), and the foot sizes and lengths vary as well, a separate skid with receptacles having a specific spacing and depth needs to be provided for each type of article foot type, size and spacing.

There is a need for a simplified skid that engages with, secures and support the feet of different types of shipping articles having varying foot types, sizes and spacings.

SUMMARY OF THE INVENTION

The present invention solves the aforementioned problems by providing a skid that receives and secures the feet of shipping articles having varying foot patterns, sizes and spacings.

Specifically, the shipping skid of the present invention includes a base member, a plurality of skid members attached to a bottom surface of the base member, a platform attached to a top surface of the base member, and a plurality of mounting plates attached to a top surface of the platform. Each of the mounting plates includes a plurality of receptacles formed into a top surface thereof, a plurality of clamp channels formed into the top surface thereof, and at least one clamp member removably and selectively attachable into each one of the clamp channels. Each of the receptacles are overlapped by at least one of the clamp channels.

In another aspect of the present invention, the shipping skid of the present invention, which is used for shipping an article that is mounted on a plurality of feet, includes a base member, a plurality of skid members attached to a bottom surface of the base member, a platform attached to a top surface of the base member, and a plurality of mounting plates attached to a top surface of the platform. Each of the mounting plates includes a plurality of clamp channels formed into the top surface thereof, a plurality of receptacles formed into a top surface thereof that are each overlapped by at least one of the clamp channels, and at least one clamp member having engagement prongs and being removably and selectively attachable into each of the clamp channels. When an article foot is inserted into one of the receptacles and the clamp member is attached into the corresponding clamp channel that overlaps that receptacle, the engagement prongs engage with the foot and secure the foot to the mounting plate.

Other objects and features of the present invention will become apparent by a review of the specification, claims and appended figures.

DETAILED DESCRIPTION OF THE PREFERRED EMBODIMENTS

The present invention is a shipping skid that provides receptacles and clamps that are compatible with multiple types of shipping article foot sizes and spacings.

Figure 1:
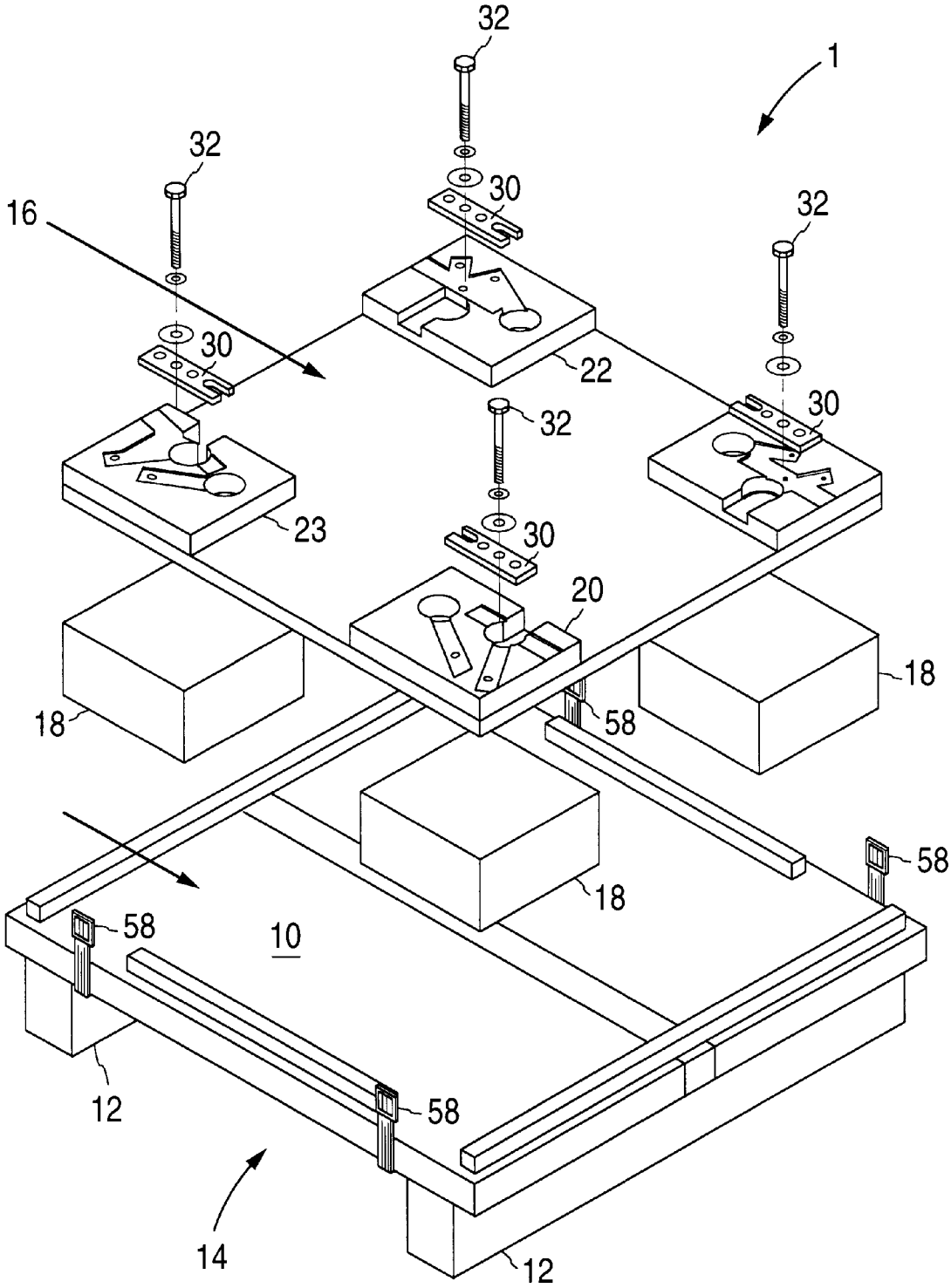
FIG. 1 is an exploded perspective view of the shipping skid of the present invention.

The skid 1 of the present invention is illustrated in FIG. 1, and includes a base 10 supported by elongated skid members 12 to provide an access area 14 underneath base 10 so that forklift prongs can pick up and move the skid 1.

A floating platform 16 is mounted to the top surface of base 10 via elastic members 18. The platform 16 is preferably rectangular, with mounting plates 20, 21, 22 and 23 mounted to the corners of the top surface of platform 16.

Each mounting plate 20–23 contains a plurality of receptacles 24, clamp channels 26 and threaded bolt holes 28. Clamp members 30 and bolts 32 are used to secure the feet of shipping articles to each mounting plate 20–23 as described below.

Figure 2A:
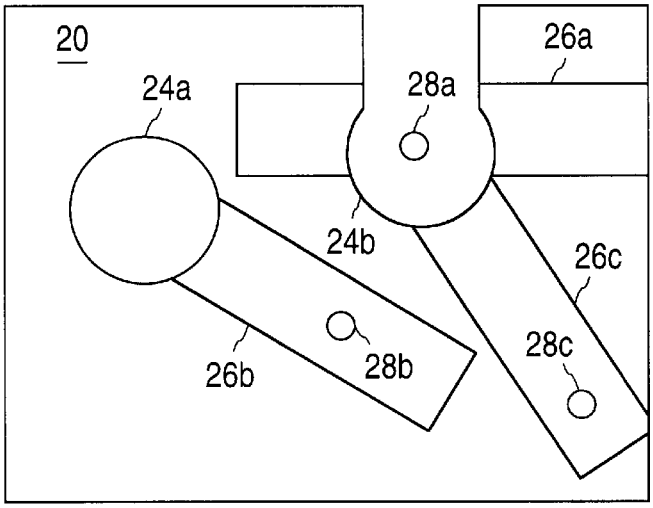
FIGS. 2A–2D are top views of the mounting plates of the present invention.
Figure 2B:
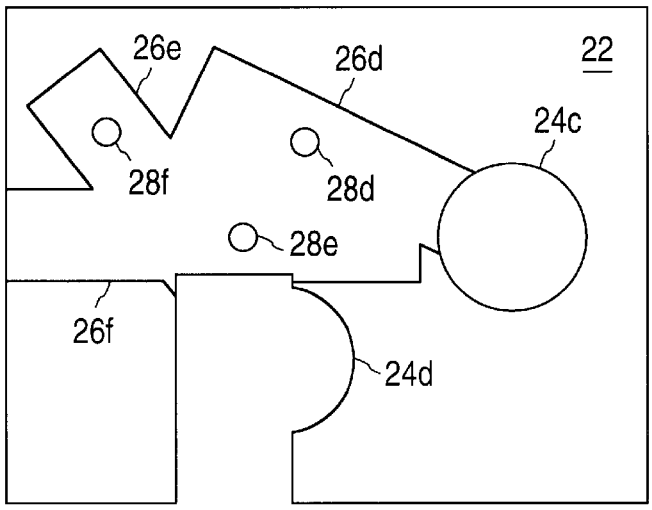
Figure 2C:
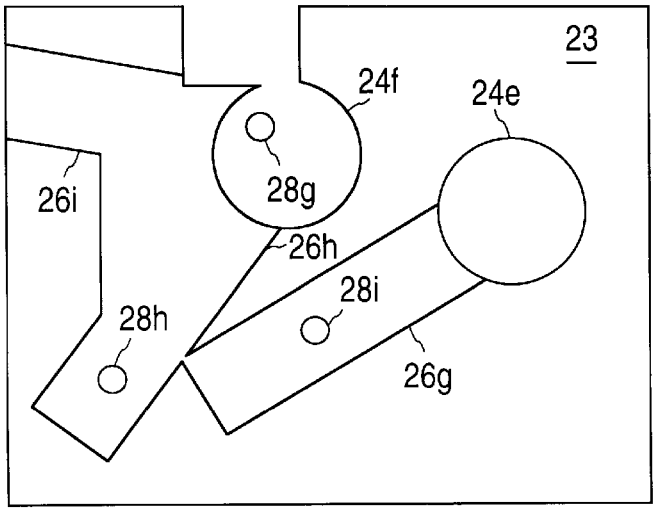
Figure 2D:
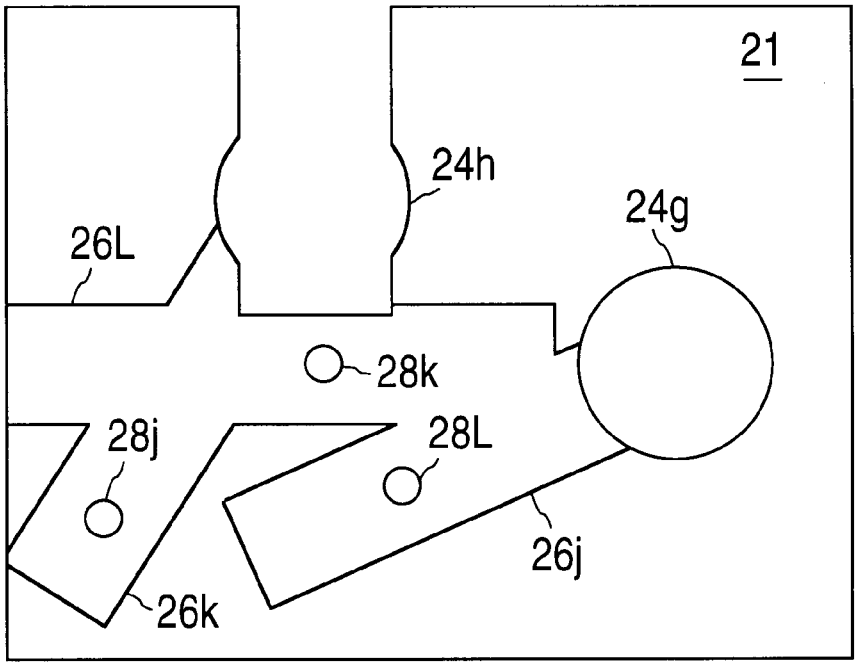
Figure 3:
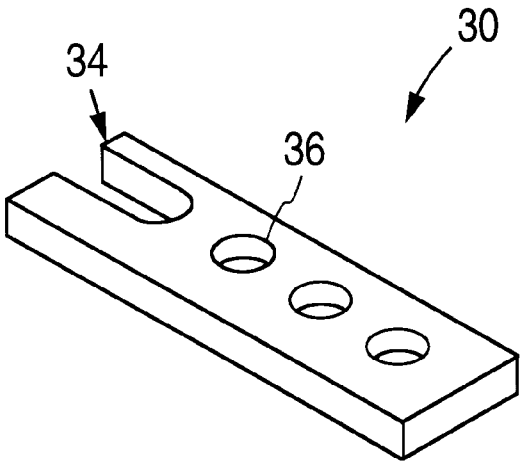
FIG. 3 is a perspective view of the clamp used with the skid of present invention.
Figure 4:
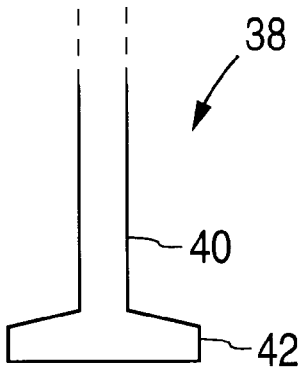
FIG. 4 is a side view of a foot from a shipping article.
Figure 5:
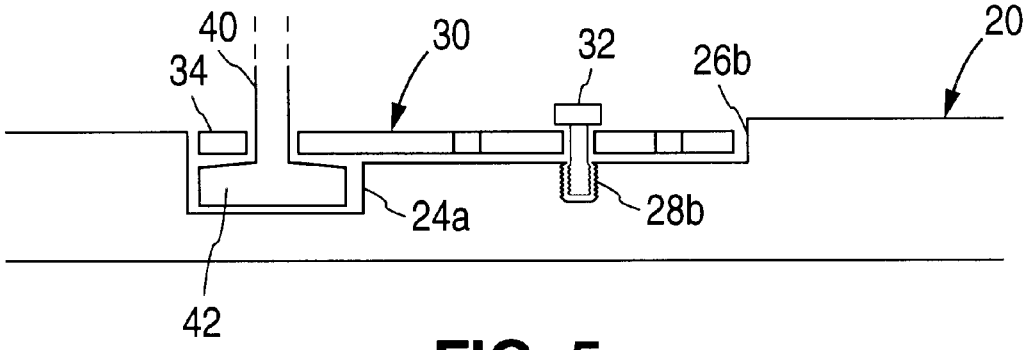
FIG. 5 is a side cross-sectional view illustrating an article foot secured to one of the receptacles of the present invention.

FIG. 2A illustrated mounting plate 20, which includes receptacles 24*a* and 24*b*; clamp channels 26*a*, 26*b*, and 26*c*; and threaded bolt holes 28*a*, 28*b* and 28*c*. FIG. 3 illustrates clamp members 30, which include engagement prongs 34 and bolt holes 36. FIG. 4 illustrates a foot 38 that is ideal for use with the present invention. Foot 38 extends down from a shipping article and has a leg portion 40 and foot pad 42. To secure shipping article foot 38 to mounting plate 20, foot pad 42 is inserted into one of the receptacles, for example receptacle 24*a*. Then, a clamp member 30 is mounted in clamp channel 26*b* by a bolt 32 in bolt hole 28*b* so that prongs 34 engage around leg portion 40 and over foot pad 42, as illustrated in FIG. 5. Alternately, if foot 38 were aligned to receptacle 24*b*, then foot pad 42 would be inserted therein and clamp 30 would be secured in clamp channel 26*c* using bolt hold 28*c*. The same clamping technique is then used for other feet 38 using receptacles 24*c*–24*h*, clamp channels 26*d*, 26*e*, 26*h*, 26*g*, 26*j* and 26*k*, and threaded bolt holes 28*d*, 28*f*, 28*h*, 28*i*, 28*j* and 28*l*, of mounting plates 21–23, as illustrated in FIGS. 2B to 2D. Note that each receptacle 24 has at least one clamp channel 26 that overlaps (formed integrally with) the respective receptacle 24, which dictates which clamp channel(s) 26 is (are) used to secure the article foot inserted in any given receptacle 24.

Each mounting plate 20–23 provides a plurality of foot receptacles so that a plurality of foot patterns can be accommodated by a single floating platform 16. One or more clamp channels may be provided for each receptacle so that, depending on the shape of the article, at least one clamp channel can be accessed to clamp the respective foot 38 in the respective receptacle 24.

Each mounting plate 20–23 can have different receptacle and clamp channel orientations, as illustrated in FIGS. 2A–2D, depending upon the various foot patterns that need accommodating. Some orientations can include receptacles, such as 24*b*, 24*d*, 24*f* and 24*h*, formed continuously with a side of the mounting plate, to form an open slot so that feet 38 (some of which might be specially shaped) can be slid into these receptacles either before or after the clamp 30 is mounted in place.

Figure 6A:
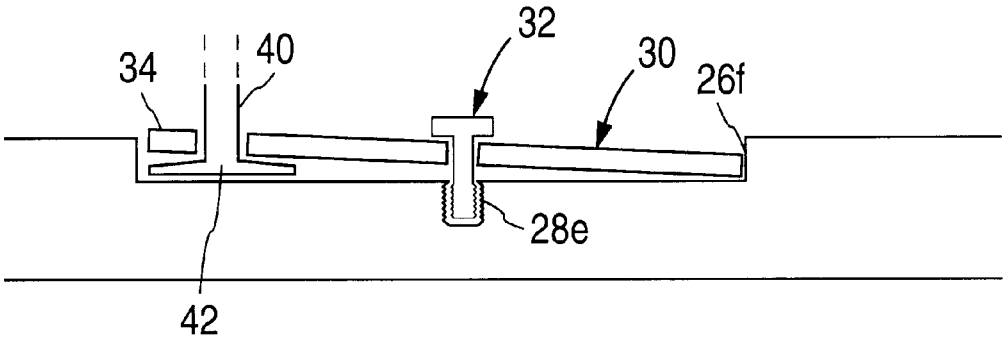
FIGS. 6A–6B are side cross-sectional views of article feet secured to a clamp channel of the present invention.
Figure 6B:
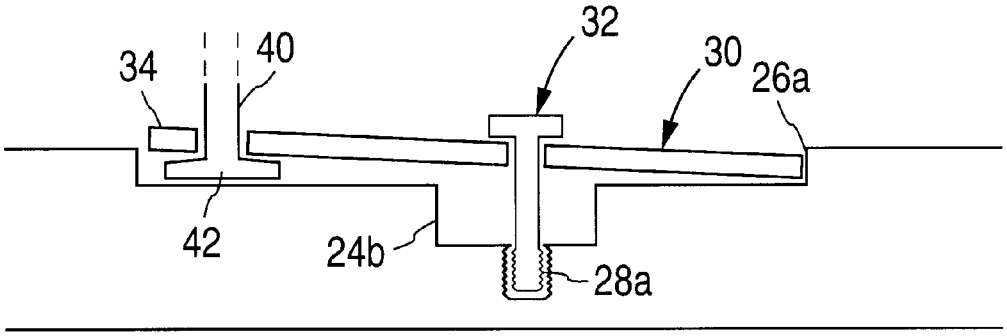

Certain clamp channels, such as 26*a*, 26*f*, 26*i* and 26*l*, are not oriented so that the clamp prongs 34 of a clamp 30 mounted therein are disposed over a receptacle 24. Instead, these clamp channels are used to clamp feet having thin foot pads 42 that are aligned to and rest inside these clamp channels. For example, FIG. 6A illustrates a foot clamped in place inside clamp channel 26*f*, and FIG. 6B illustrates a foot clamped in clamp channel 26*a* and bolt 32 is engaged in bolt hole 28*a* located inside receptacle 24*b*.

Figure 7:
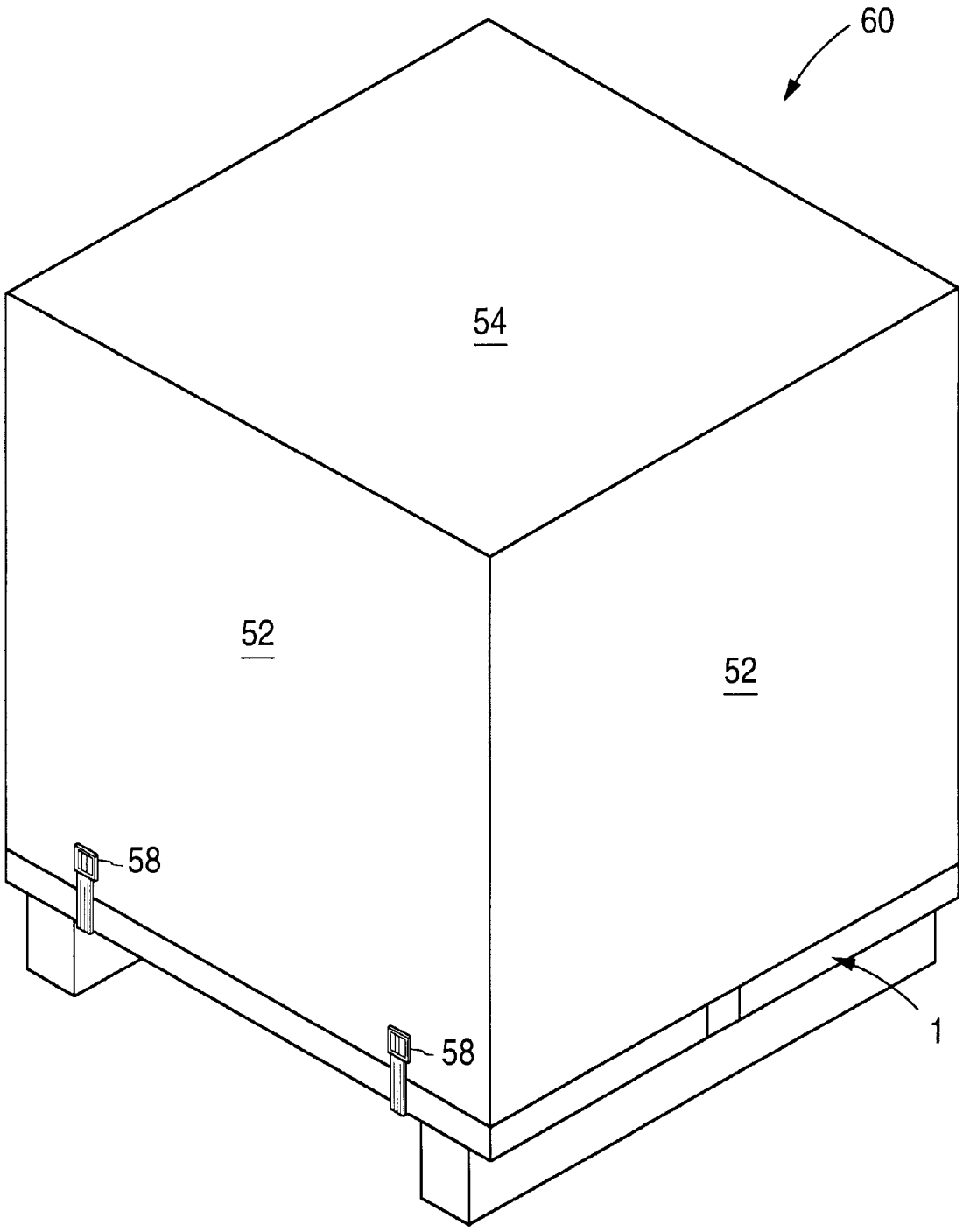
FIG. 7 is a perspective view of shipping container with the skid of the present invention.

The skid 1 of the present invention can be used in conjunction with a box 50, forming four side walls 52 and a lid 54, that is removably attached to the skid 1 by using straps (not shown) or Tubitsu Clips 58, in order to form a shipping container 60, as illustrated in FIG. 7.

The preferred materials for base 10, skid member 12 and platform 16 are wood or particle board, but can also be made of wood pulp, plywood, plastic or metal. Mounting plates are preferably made of metal, but could be made of wood, particle board, or plastic. Elastic members 18 are preferably made of foam, plastic blow molded donut shaped devices, or any other shock absorbing material, and are attached to base 10 and platform 16 with glue. The elastic members protect the shipping article mounted on platform 16 from external shocks and vibrations. Box 50 can be formed of wood, particle board, wood pulp, plastic and/or metal.

It is to be understood that the present invention is not limited to the embodiments described above and illustrated herein, but encompasses any and all variations falling within the scope of the appended claims. For example, walls 52 and lid 54 can be separate members removably attached together and to skid 1. Further, the number and position of the mounting plates, together with the number and position of receptacles and clamp channels therein, can vary to accommodate any desired number of foot patterns for articles being shipped by skid 1. The number and position of the elastic members can also be varied. In addition, the receptacles could extend all the way through the mounting plates, so that the feet rest on, and bolt holes 28*a* and 28*g* are formed into, the top surface of platform 16. Lastly, the number and shape of the skid members 12 can be varied.

What is claimed is:

1. A shipping skid, comprising:

a base member;

a plurality of skid members attached to a bottom surface of the base member;

a platform attached to a top surface of the base member;

a plurality of mounting plates attached to a top surface of the platform, each of the mounting plates including:

a plurality of receptacles formed into a top surface thereof, a plurality of clamp channels formed into the top surface thereof, and at least one clamp member removably and selectively attachable into each one of the clamp channels;

wherein each of the receptacles being formed integrally with at least one of the clamp channels.

2. The shipping skid according to claim 1, further comprising:

at least one elastic member attached to the base member, wherein the platform is attached to the elastic member.

3. The shipping skid of claim 2, wherein for each of the mounting plates, at least one of the clamp channels is formed integrally with at least one of the receptacles.

4. The shipping skid of claim 2, wherein for each of the mounting plates, each of the receptacles is formed integrally with at least one of the clamp channels.

5. The shipping skid of claim 4, wherein for each mounting plate, the clamp member includes engagement prongs that overlap one of the receptacles when the clamp member is attached into the clamp channel that is formed integrally with the one receptacle.

6. The shipping skid of claim 5, wherein for each mounting plate, at least one of the clamp channels is not formed integrally with any of the receptacles.

7. The shipping skid of claim 2, wherein for at least one of the mounting plates, at least one of the receptacles is formed continuously with a side of the mounting plate to form an open slot.

8. The shipping skid according to claim 2, further comprising:

a plurality of wall members removably attached to the base member; and a lid member attached to the wall members, wherein the base member, the plurality of wall members and the lid form an enclosed shipping container.

9. A shipping skid for shipping an article that is mounted on a plurality of feet, comprising:

a base member;

a plurality of skid members attached to a bottom surface of the base member;

a platform attached to a top surface of the base member;

a plurality of mounting plates attached to a top surface of the platform, each of the mounting plates including:

a plurality of clamp channels formed into the top surface thereof, a plurality of receptacles formed into a top surface thereof integrally with at least one of the clamp channels, and at least one clamp member having engagement prongs and being removably and selectively attachable into each of the clamp channels;

wherein when an article foot is inserted into one of the receptacles and the clamp member is attached into the corresponding clamp channel that is formed integrally with that receptacle, the engagement prongs engage with the foot and secure the foot to the mounting plate.

10. The shipping skid according to claim 9, wherein for each mounting plate, at least one of the clamp channels is not formed integrally with the receptacles, and wherein when an article foot is inserted into, and the clamp member is attached into, the non-integrally formed clamp channel, the engagement prongs engage with the foot and secure the foot to the mounting plate.

11. The shipping skid according to claim 9, further comprising:

at least one elastic member attached to the base member, wherein the platform member is attached to the elastic member.

12. The shipping skid of claim 9, wherein for at least one of the mounting plates, at least one of the receptacles is formed continuously with a side of the mounting plate to form an open slot.

13. The shipping skid according to claim 9, further comprising:

a plurality of wall members removably attached to the base member; and a lid member attached to the wall members, wherein the base member, the plurality of wall members and the lid form an enclosed shipping container.

14. A shipping skid, comprising:

a platform supported by a plurality of skid members;

a plurality of mounting plates attached to a top surface of the platform, each of the mounting plates including:

a plurality of receptacles formed into a top surface thereof, a plurality of clamp channels formed into the top surface thereof, and at least one clamp member removably and selectively attachable into each one of the clamp channels;

wherein each of the receptacles being formed integrally with at least one of the clamp channels.

15. The shipping skid according to claim 14, further comprising:

a base member attached to top surfaces of the plurality of skid members;

at least one elastic member attached to a top surface of the base member;

wherein the platform is attached to a top surface of the elastic member.

* * * * *